US006367639B1

(12) United States Patent
Mar

(10) Patent No.: US 6,367,639 B1
(45) Date of Patent: Apr. 9, 2002

(54) SAFETY CONTAINER PROVIDING OPTIONAL OPENING AND CLOSING ARRANGEMENTS

(76) Inventor: Bob Mar, 1025 Rosemarie La., D-8, Stockton, CA (US) 95207

( * ) Notice: Subject to any disclaimer, the term of this patent is extended or adjusted under 35 U.S.C. 154(b) by 0 days.

(21) Appl. No.: 09/280,226

(22) Filed: Mar. 29, 1999

(51) Int. Cl.[7] ..... B65D 55/02

(52) U.S. Cl. ..... 215/213; 215/211; 215/235; 215/237; 220/323; 220/324; 220/837; 292/164

(58) Field of Search ..... 215/213, 211, 215/235, 237, 216, 201, 221; 220/315, 810, 820, 836, 837, 323, 324; 190/120, 119; 292/175, 145, 169.14, 162, 164, DIG. 11; 70/289, 290

(56) References Cited

U.S. PATENT DOCUMENTS

| | | | | | |
|---|---|---|---|---|---|
| 3,240,039 | A | * | 3/1966 | Baerman | |
| 3,576,238 | A | * | 4/1971 | Chubb | 190/120 |
| 3,642,161 | A | * | 2/1972 | Stroud | 215/213 |
| 3,860,135 | A | | 1/1975 | Yung et al. | |
| 3,924,768 | A | | 12/1975 | Lemons | |
| 3,987,876 | A | * | 10/1976 | Foults | 190/120 |
| 4,094,392 | A | * | 6/1978 | Gregg et al. | 190/120 |
| 4,146,146 | A | | 3/1979 | Mar | |
| 4,257,537 | A | | 3/1981 | Uhlig | |
| 4,358,022 | A | * | 11/1982 | Geiger | |
| 4,458,819 | A | * | 7/1984 | Geiger | |
| 4,509,622 | A | * | 4/1985 | Morszeck | 190/119 |
| 4,535,903 | A | | 8/1985 | Franchi | |
| 4,576,307 | A | * | 3/1986 | Frydenberg | 190/119 X |
| 4,852,770 | A | * | 8/1989 | Sledge et al. | 215/216 X |
| 4,984,698 | A | * | 1/1991 | Stuckey | 220/210 X |
| 5,000,339 | A | * | 3/1991 | Wheat et al. | 220/210 X |
| 5,040,691 | A | * | 8/1991 | Hayes et al. | 215/216 |
| 5,193,707 | A | * | 3/1993 | Mizumura | 220/324 X |
| 5,346,069 | A | * | 9/1994 | Intini | 215/216 X |
| 5,370,081 | A | * | 12/1994 | Gordon | 220/323 X |
| 5,394,966 | A | * | 3/1995 | Chow | 190/119 |
| 5,460,288 | A | | 10/1995 | Balzean | |
| 5,682,910 | A | | 11/1997 | Kizawa et al. | |
| 5,752,612 | A | * | 5/1998 | Fritzche et al. | 215/216 X |
| 5,908,131 | A | * | 2/1999 | Yamaguchi | 220/315 X |
| 5,887,736 | A | * | 3/1999 | Mar | 215/213 |
| 6,059,135 | A | * | 5/2000 | James et al. | |

FOREIGN PATENT DOCUMENTS

| | | | | |
|---|---|---|---|---|
| EP | 609955 | * | 8/1994 | 215/216 |

* cited by examiner

*Primary Examiner*—Allan N. Shoap
*Assistant Examiner*—Robin A. Hylton
(74) *Attorney, Agent, or Firm*—Bernhard Kreten

(57) ABSTRACT

A safety container incorporates a slidable locking pin with an integral but separately lockable locking tab. The locking pin is internally biased by an integral S-spring which, in cooperation with the lid on the container, urges the pin to slide in a slideway in the lid of the container. The locking pin may be locked into a closed position, however, by rotation of the locking tab into a flexed position. In this position, the locking tab cannot slide within a mating slot in the hinge lid and thus the locking pin cannot slide in the slideway in the lid. Alternatively, the locking tab may be rotated into a non-flexed position in which the locking tab can be urged to penetrate the mating slot in the lid and allow the locking pin to slide in the slideway in the lid. By use of the locking pin, the safety container can be set to require the user to engage in at least distinct hand motions in order to open the container.

57 Claims, 3 Drawing Sheets

SAFETY CONTAINER PROVIDING OPTIONAL OPENING AND CLOSING ARRANGEMENTS

FIELD OF THE INVENTION

The present invention relates to safety containers. More specifically, this invention relates to safety containers of the type having removable lids that are intentionally designed to be difficult for children to open in order to gain access to the contents of the container.

BACKGROUND

Pharmaceutical manufacturers, pharmacists, and others have long sought to provide safety containers for contents such as drugs and other potentially dangerous contents. The object of their search has been to provide a container that can be opened readily by an adult but not by a child.

One safety container that has existed for some time is the "push-and-twist" container. The push-and-twist container requires that the person opening the container push down rather forcefully on the cap of the container and simultaneously twist the cap to unscrew it and move it to a position where it can be lifted off of the container.

One problem with the push-and-twist type of container is that the twist cap entirely separates from the container when the container is opened. The cap can be lost, and in any event, the separate cap requires effort to locate and place the cap back onto the container body in order to close the container. In addition, when the user has multiple such containers open, as is often the case for elderly persons who often must take more than one type of drug at a time, the user can mix-up the lids and place the wrong cap on the wrong container or, because of the effort required to keep track of the disparate caps and replace them on the correct container, simply leave the caps off of their containers. These types of mix-ups or failure to even close the containers defeats the very purpose of putting a safety cap or lid on the container at all.

Another problem with the push-and-twist container is that it requires only one pushing and twisting motion in order to open the container. A child need only figure out that one push-and-twist motion in order open the container or others like it.

Yet another problem with the push-and-twist container is that it has only one mode of closing and opening. Many people, however, rarely if ever have children in their homes. At the same time, they may be weak or suffer from coordination difficulties that render it difficult and perhaps even impossible to perform the push-and-twist motion. Even in the case of a healthy adult, the user may not want, and have no need to utilize, any more than minimal safety features on a particular safety container. For these and other reasons, these types of users may have no need, desire, or ability to themselves repeatedly engage in the substantial push-and-twist effort required to utilize the push-and-twist container. For these types of users, the push-and-twist and similar types of safety containers do not provide an adequate solution to the problem of providing a container that will be relatively securely closed when not in use, depending on the needs of the user.

One solution to these types of problems is the hinge-lid safety container, such as that shown is U.S. Pat. No. 4,146,146, entitled "Safety Containers" ("the '146 patent"). Because the hinged lid is secured to the container by the hinge, the cap is not lost, misplaced, or difficult to position adjacent the opening of the container when closing the container.

With the device shown in the '146 patent the lid is opened by inserting a sufficiently long fingernail into a relatively small and hidden slot in a locking pin slidably mounted in the lid, and then pulling, with the finger nail, the pin out of its force-fit engagement with the upper lip of the container in order move the pin away from the force-fit engagement and the lid to rotate into the open position. The '146 device is often easier for many seniors and others to use than the twist-and-pull container because, once the pin is pulled out and the cap is opened, the cap may be opened and relatively securely closed without resetting the pin.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 3,860,135 | January 14, 1975 | Yung, et al. |
| 3,924,768 | December 9, 1975 | Lemons |
| 4,146,146 | March 27, 1979 | Mar |
| 4,257,537 | March 24, 1981 | Uhlig |
| 4,535,903 | August 20, 1985 | Franchi |
| 5,460,288 | October 24, 1995 | Balzeau |
| 5,682,910 | November 4, 1997 | Kizawa, et al. |

BRIEF SUMMARY OF THE INVENTION

The applicant has discovered that one way to render a container less likely to be opened by children is to preferably require two independent finger motions, at least one of which preferably requires some dexterity, preferably in addition to a third cap removal motion. The applicant has further discovered that a safety container should offer a capable adult the option of defeating certain safety features or steps that are unnecessary for containers used in, for example, a home unoccupied and not visited by children.

The applicant has invented a safety container having a locking pin slidably mounted in the container cover or lid to move between a locking and opening position. The lid has a tab detent or slot, and the locking pin has locking tab that is moveable between (i) an opening position in which the tab locking tab can move or slide into the detent to allow the pin to move with respect to the lid, and (ii) a locking position in which the tab cannot sufficiently penetrate the detent and allow motion of the pin with respect to the lid.

Preferably, the locking tab is rotatable in a plane perpendicular to the slide plane of the locking pin, and the lid is hinge mounted on the container. Preferably, the locking tab is resilient, and flexes about the periphery of a tab protuberance upon movement of the locking tab between its opening and lock-out position. Preferably, the locking pin includes automatic spring-biasing of the pin toward locking position. Most preferably, the spring is S-shaped, molded integrally with the locking pin, and has an end that engages the cover in order to bias the locking pin toward the locking position.

Preferably, the locking pin automatically slides into position to secure the lid in a securely closed position on the container by a single closing motion of the user's hand pushing the lid toward the container body.

The present invention may be utilized to safely contain pharmaceuticals. It also may be used to more safely contain other types of hazardous materials, such as cleaning fluids or powders.

There are a number of other aspects of the present invention. They will become apparent as the specification proceeds. It is to be understood, however, that the scope of the present invention is to be determined by reference to the accompanying claims and not by whether all aspects of the invention summarized herein are included in a given embodiment.

OBJECTS AND ADVANTAGES OF THE PRESENT INVENTION

It is an object of the present invention to provide a better, more versatile, easily manufactured, and economical safety container.

It is an advantage flowing from the present invention that it provides a container that is more easily utilized by senior citizens and others not requiring use of all safety features at all times.

It is yet an additional advantage of the present invention that it is less likely to be openable by children, particularly when all safety features are employed by the person who dispenses and by the adult who maintains or uses the container.

It is another advantage of the present invention that an adult may adjust the safety container so that it is easier to open and close, and re-open and close, etc., when access to the container by children is not a concern.

Conversely, another advantage is that the container may later be readjusted to again provide the highest level of safe closure (vis a vis children) when and if access by children becomes a concern.

Yet another advantage is that the present invention may be opened without actually completely separating the cap from the container and perhaps losing the cap or misplacing it with the wrong cap.

An additional advantage is that the user is less likely to fail to re-close the present container.

A further advantage is that present invention does not require great dexterity on the part of an adult or the use of a fingernail in order to open and close the cap.

A related advantage is that the present invention can be set to require two separate finger motions in order to then perform yet a third motion in order to open the container. This renders the cap quite difficult for children, and people who may not appreciate the danger of misuse of the contents, to gain access to the contents of the container without the aid of a capable adult.

It is also an advantage of the present invention that the cover or lid locking mechanism automatically locks the lid in closed position on the container with one simple hand motion and without need for difficult pushing and/or twisting motions by the user.

The present invention thus provides a safer, economical, easily manufactured, easily used, and versatile container for potentially hazardous materials.

There are other objects and advantages of the present invention. They will become apparent as the specification proceeds. It is to be understood, once again, that the scope of the present invention is to be determined according to the accompanying claims and not by whether a given embodiment achieves all the objects and advantages recited herein.

BRIEF DESCRIPTION OF THE DRAWINGS

The applicant's preferred embodiment is shown in the accompanying drawings in which.

Figure 1:
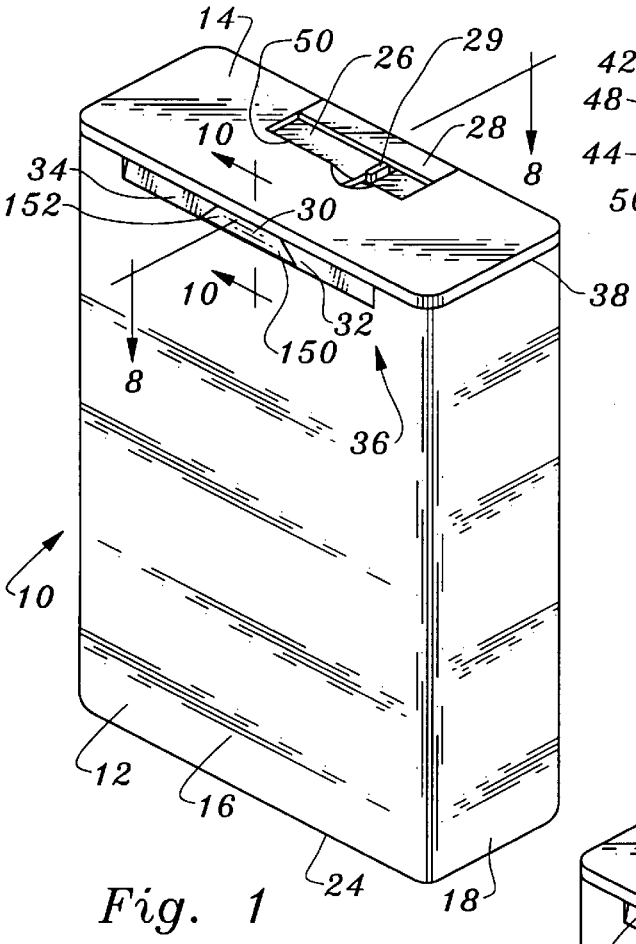
FIG. 1 is a perspective view of the applicant's preferred safety container.

The following detailed description of the preferred embodiment uses spatially orienting terms such as "upper," "lower," and "bottom" for example. It is to be understood that such terms are used for convenience by reference to the structure shown in the drawings and do not in themselves limit or require a particular orientation of the structure in space.

DETAILED DESCRIPTION OF THE PREFERRED EMBODIMENT

Referring now to FIG. 1, the applicant's preferred safety container, generally 10, has a generally box-shaped container body 12 and a hinged, generally rectangular lid 14 for safely closing the container 10 and opening it to remove material (not shown) or insert material into the container 10. The container body 12 is integral and has four generally rectangular sides 16, 18, 20, 22 (20, 22 shown in FIG. 5) extending from a generally rectangular floor or bottom side 24.

The hinged lid 14 has a locking pin 26 slidably mounted along the plane of the lid 14 in a slideway 27 (shown in FIG. 5) on the underside 25 (shown in FIG. 5) of the lid 14. The locking pin 26 has a finger actuation pad 28 on one end of the locking pin 26 opposite a T-lock 30 on the other end of the locking pin 26. The T-lock 30 retains the lid 14 in its closed position, as shown FIG. 1, when the T-lock abuts mating, opposing locking necks 32, 34 in the upper lip, generally 36, of the central container body 12. In this fashion, the lower edge 38 of the hinged lid 14 securely abuts the lid 36 to seal the container 10. The "T" lock 30 is contoured as an isosceles trapezoid with the equal sides canted upwardly and inwardly. The locking necks 32, 34 are complementally formed. Collectively lock 30 and neck 32, 34 define a dovetail lock having considerable strength.

Figure 2:
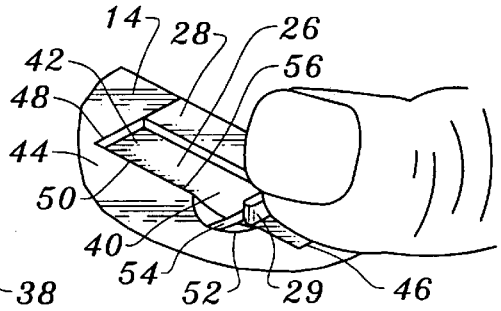
FIG. 2 is a partial perspective view of the top of the cover or lid of applicant's preferred container showing how a person may use a thumb or other finger to rotate the locking tab toward the unlocked or open position.

Referring now to FIG. 2, the hinge lid 14 has an actuation pad channel 42 penetrating the upper surface 44 of the lid 14 adjacent the slideway 27. The actuation pad 28 may slide in the pad channel 42 when the locking pin 26 is mounted in the slideway 27.

The pad channel 42 has two opposing, parallel channel sides 46, 48 interconnected by a pad abutment or stop edge 50 perpendicular to the opposing channel sides 46, 48. The portion of the upper surface 44 of the lid 14 immediately adjacent the pad abutment 50 has a semicircular or half-moon, concave finger access depression 52 centered on the abutment 50 between the two channel sides 46, 48. The access depression 52 has a locking tab detent or slot 54 extending perpendicularly from the interior edge 56 of the abutment 50 through the axial center of the depression 52.

Figure 3:
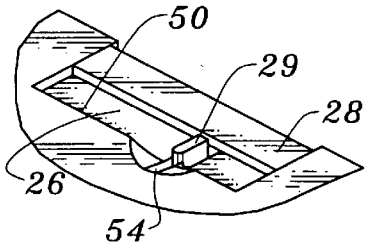
FIG. 3 is a partial perspective view of the top of the lid in applicant's preferred safety container, with the locking tab in the open or unlocked position.

The locking pin 26 has a rotatable locking tab 29 extending vertically upwardly from the middle of the central portion 40 of the locking pin 26 adjacent the finger actuation pad 28 on the pin 26 and also adjacent the locking tab slot 54. The locking tab 29 must be aligned with the opposing tab slot 54 in order for the finger pad 28 and associated locking tab 29 to move toward the abutment 50. In order to so align the locking tab 29, the user can use a finger to rotate and translate the locking tab 29 so that it is generally co-planar with the tab slot 54, as shown in FIG. 3.

Figure 4:
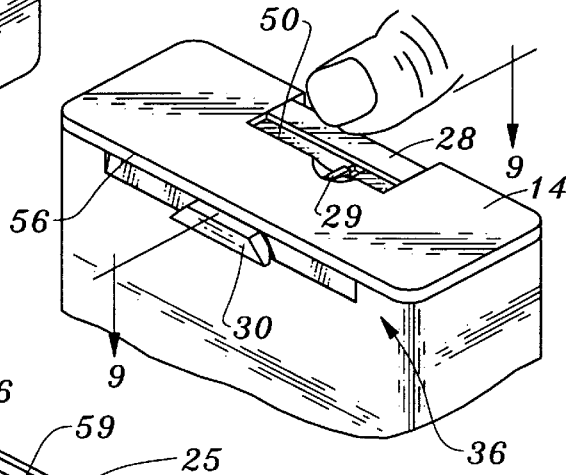
FIG. 4 is a partial perspective view of the upper portion of the applicant's preferred container showing how a person may use a thumb or finger in a second motion, separate from the first motion of FIG. 3, to push and slide the locking pin into an open position.
Figure 5:
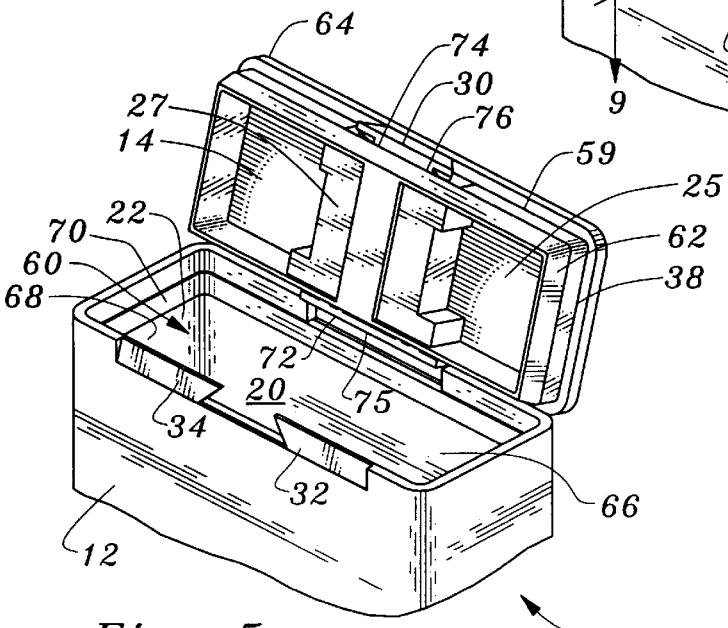
FIG. 5 is a partial perspective view of the upper section of the applicant's preferred embodiment showing how the safety lid is hinge mounted on the upper lip of the preferred container.

With this orientation of the locking tab 29 and the tab slot 54, the locking tab 29 can penetrate the tab slot 54 when, as shown in FIG. 4, the user undertakes a second finger motion, pushing the finger pad 28 on the locking pin 26 toward the pad abutment 50. By thus pushing the pad 28 and associated pin 26 to slide in the slideway 27 (shown in FIG. 5), the opposite T-lock end 30 is forced outwardly from engagement with the upper lip 36. As a result, the user can then use yet a third hand motion—the other hand—to rotate the non-hinged, opening end 59 of the hinge lid 14 radially upwardly, as shown in FIG. 5, away from the container lip 36. In this fashion, the user opens the container 10 and gains access to the interior 60 of the container 10 and container body 12.

With continuing reference to FIG. 5, the lid 14 has a stepped lip ridge 62 extending perpendicularly from the plane of the underside 25 of the lid 14. The lip ridge 62 is spaced inwardly from the peripheral side edge 64 of the lid 14 so that the ridge 62 provides a force-fit against the interior side walls, e.g., 66, 68, of the container 12. Toward this end, the interior side walls 66, 68 have a mating stepped upper interior lip ridge 70 embodied as an interiorly peripherally circumscribing gasket, preferably formed from santoprene, adapted to force-fit align with the stepped lip ridge 62 as the lid 14 is closed on the container 12, as shown in FIG. 1 (see FIG. 11 also).

Referring to FIG. 5, the lid 14 is permanently mounted on the container body 12 by a hinge 72 on the hinged side 75 of the lid 14 opposite its opening end 59. The structure and operation of the hinge 72 may include biasing so that the lid starts to rotate open once the lock 30 is clear of the necks 32, 34.

The locking pin slideway 27 extends from the underside 38 of the lid 14 perpendicularly between the opening end 59 and the hinged side 75 of the lid 14 to abut and penetrate the stepped lip ridge 62 at each of the two opposing ends 76, 77 (77 shown in FIG. 6) of the slideway 27. The T-lock end 30 thus extends through the opening-side slideway passage 74 penetrating the stepped lip ridge 62 on the opening end 59 of the hinge lid 14.

Figure 6:
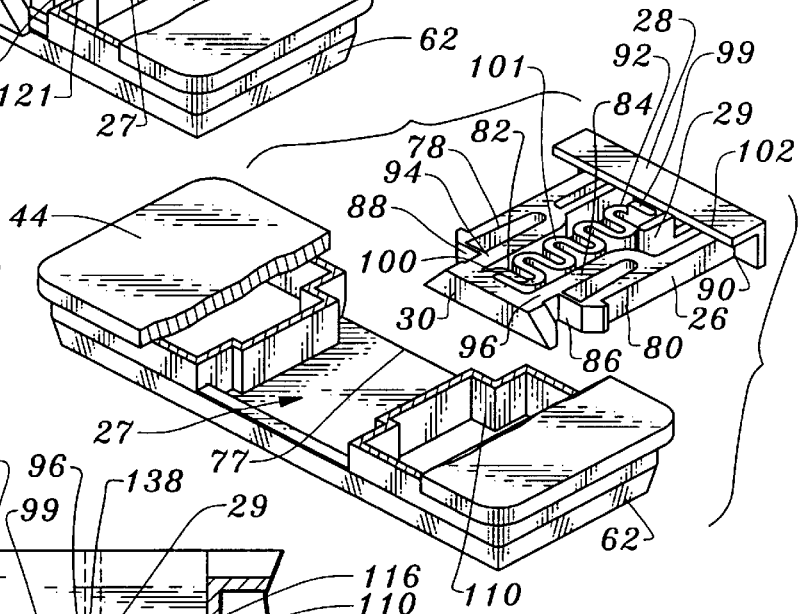
FIG. 6 is a partial perspective view of the cover shown in FIG. 6 prior to assembly of the separated locking pin into the pin slot in the lid.

Referring now to FIG. 6, the locking pin 26 is an integral, unitary structure molded preferably from acetal for strength, resilience, and flexibility of the thinner sections in the structure. The locking pin 26 has two parallel, opposing guide rails 78, 80 extending perpendicularly from the actuation pad 28.

Two interior support rails 82, 84 extend respectively from and between the opposing guide rails 78, 80. The interior support rails 82, 84 also extend substantially parallel to the guide rails 78, 80 and beyond the guide rail ends 86, 88 opposite the intersection or junction 90 of the guide rails 78, 80 with the actuation pad 28. The support ends 94, 96 of the support rails 82, 84 that extend past the guide rail ends 86, 88 perpendicularly intersect, join, and support the transversely extending T-lock 30.

An S-shaped spring member 92 having a plurality of "S" shaped serpentine bends extends from the T-lock 30 toward the actuation pad 28 intermediate the opposing support rails 82, 84. The S-body 101 of the S-spring 92 lies between and in a plane parallel to the support rails 82, 84. A spring lip 99 extends perpendicularly from the plane of the S-spring 92 at the spring end 98 of the S-spring 92 opposite the fixed end 100 of the S-spring extending from the T-lock 30 spring end 98 securely abuts pad neck 112. The spring lip or stop 99 also is perpendicular to the plane of the locking tab 29 and adjacent and parallel to the interior edge 102 of the actuation pad 28.

Figure 8:
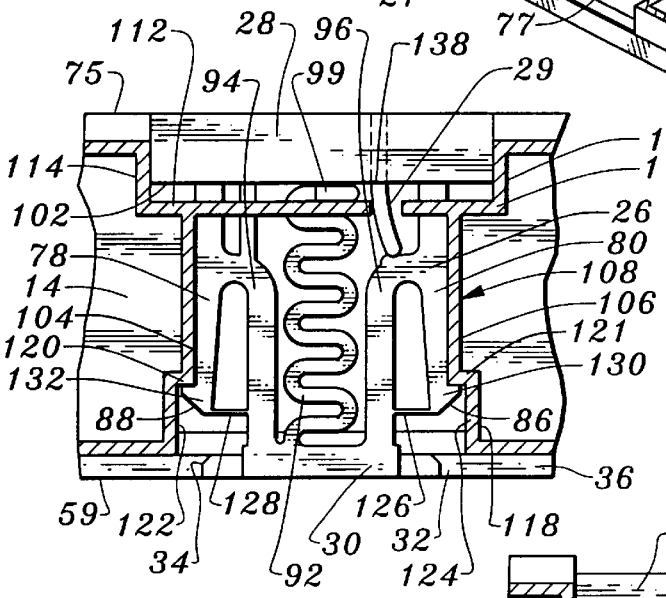
FIG. 8 is a partial cross-sectional view of the lid of FIG. 1 taken along section line 8—8 of FIG. 1, with the locking tab in the locking position rather than in the open position as shown in FIG. 1.

Referring now to FIG. 8, the slideway 27 has two central, parallel opposing sides 104, 106 providing a central side boundary, generally 108, for the slideway 27. The opposing slideway sides 104, 106 are parallel to, and slidably abut, the mating guide rails 78, 80 on the locking pin 26 when the locking pin 26 is mounted in the slideway 27.

The slideway 27 also has a widened actuation pad passage section 110 co-extensive with, as shown in FIG. 2, the actuation pad channel 42 in the upper surface 44 of the lid 14. The widened pad passage section 110 of the slideway 27 is therefore at the end of the central side boundary 108 adjacent the hinged end or side 75 of the lid 14. The junction of the narrower central side boundary 108 and the widened actuation pad passage 110 provides an integrally molded pad neck 112 that is: (i) perpendicular to the sides of slideway sides 104, 106 and the adjacent sides 114, 116, respectively, of the actuation pad passage 110, and (ii) parallel to the interior edge 102 of the actuation pad 28 when the locking pin 26 is mounted in the slideway 27.

The slideway 27 also has a widened T-lock passage section 118 at the end of the central side boundary 108 adjacent the opening end or side 59 of the lid 14. The junction of the narrower central side boundary 108 and the widened actuation T-lock passage 118 provides integrally molded, opposing guide rail necks 120, 121 extending perpendicularly from, and interconnecting, the sides of slideway sides 104, 106 and the adjacent sides 122, 124, respectively, of the T-lock passage 118.

The guide rail ends 86, 88 have (i) thin web spring supports 126, 128 transversely interconnecting the ends 86, 88, respectively, with their associated support rails 96, 94; and (ii) angled necks 130, 132 extending respectively from the support springs 126, 128 transversely outwardly from their mating guide rails 80, 78, respectively. When the locking pin 26 is mounted in the slideway 27 without any deformation of the S-spring 92, the angled necks 130, 132 thus abut and fixedly grip the guide rail neck 120, 121, acting as unidirectional insertion barbs, thwarting removal of the locking pin 26. Note the locking pin 26 is initially installed as shown in FIG. 6 by sliding the pin 26 from right to left. The web spring supports 126, 128 resiliently flex in when the locking pin 26 is slide-mounted (installed) into the slideway 27 by inserting and sliding the T-lock end 30 of the locking pin 26 into the slideway 26, which forces the angled necks 130, 132 to flex toward each other by flexion of their associated web spring supports 126, 128 as the angled necks penetrate and slide through the central slideway boundary 108 and thereafter expand into widened necks 120, 121.

Still referring to FIG. 8, when the locking pin 26 is mounted in the slideway 27, the spring lip 99 abuts and is fixed to the exterior of the pad neck 112. The pad neck 112 thus restrains the spring lip 99 from entering the central slideway boundary 108. As a result, the spring-biasing provided by the integral S-spring 92 naturally urges or biases the integral angled necks 130, 132 toward abutting engagement with their respective guide rail necks 121, 120, which in turn biases the integral actuation pad 28 outwardly and spaced from the slideway boundary 108 and stop edge 50. Similarly, the S-spring 92 simultaneously biases the T-lock 30 into locking, force-fit engagement with the opposing, inwardly angled locking edges 32, 34, respectively, in the container lip 36 (see also FIG. 5). When the spring 92 is pushed as in FIG. 9, it expands and stretches storing energy which causes the spring to want to retract to the FIG. 8 position.

With continuing reference to FIG. 8, the locking tab 29 resiliently flexes about an axis perpendicular to the plane of the S-spring 92. The locking tab 29 is thus flexed or bent into an angled, lock-out position (by the finger motion described above with reference to FIG. 2) and retained in the lock-out position by a tab protuberance 138 extending outwardly thereby defining a locking tab retainer, in the direction of the locking tab 29, from the rounded periphery of the junction of the guide rail 80 and the integral support rail 96. In the lock out position shown in FIG. 8, the flexed locking tab 29 cannot penetrate, as shown in FIG. 3, the locking tab slot 54 in the hinged lid 14. As a result, the T-lock 30 is locked in interlocking relationship with the locking edges 32, 34 in the lip 36 of the container body 12. The lid 14 is thereby locked in the closed position, as shown in FIGS. 8 and 1.

Figure 9:
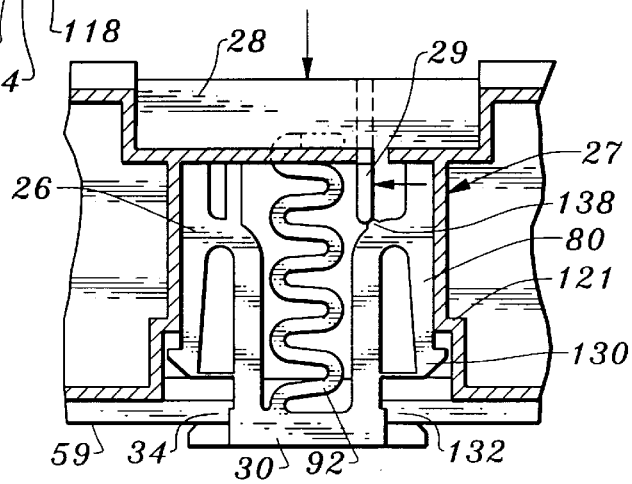
FIG. 9 is a partial sectional top view of the lid shown in FIG. 6, showing the locking tab in the unlocked or open position as also shown in FIG. 6 and the locking pin pushed to slide into the open or unlocked position.

Referring now to FIG. 9, the locking tab 29 may be rotated (as shown in FIG. 2) into the straightened or non-flexed position, by pushing the tab 29 to flex around, and thus resiliently move past, the tab protuberance or stop 138. In its non-flexed position, the resilient locking tab 29 is aligned with, as shown in FIG. 3, the mating tab slot 54. In this alignment of the locking tab 29 into an open position, the user may employ a firm second hand motion, such as shown in FIGS. 3 and 9, to push against the actuation pad 28 and thereby: (i) expand (stretch) the S-spring 92, (ii) slide the locking tab 29 into the tab slot 54, and (iii) push the T-lock 30 outwardly from force-fit engagement with the lip 36 of the container and its associated locking edges 32, 34. With yet another hand motion (not shown), the user may grasp and rotate the opening end or side 59 of the hinged lid 14 radially upwardly about the hinge (not shown in FIG. 9) so that the lid is in its open position as shown in FIG. 5. As mentioned earlier, the hinge may have a memory or other biasing mechanism that causes it to open the lid partially or totally as shown in FIG. 5.

Figure 7:
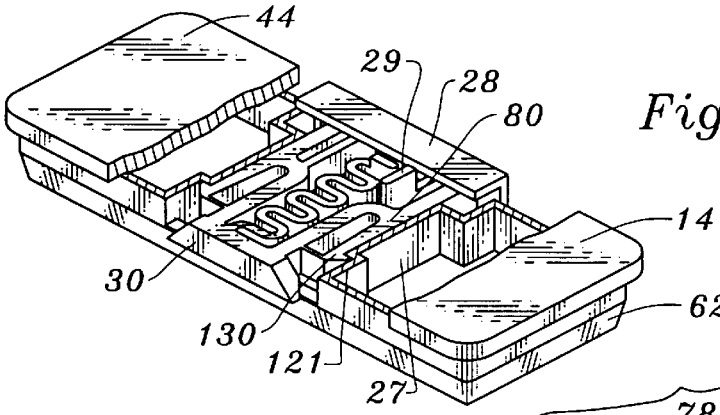
FIG. 7 is a partial perspective of the lid of the applicant's preferred embodiment, with a portion of the uppermost planar top section removed to show the interior structure of the lid and the associated spring-loaded locking pin.

Upon opening of the container 10 as shown in FIG. 5, the user may release or cease applying force against the actuation pad 28. In that event, the biasing force provided by the integral S-spring urges the actuation pad 28, the T-lock 30, and their associated integral structures into the slideway 27 back to the free state position of the locking pin 26 (as shown in FIG. 7) in which the angled necks, e.g., 130, on the guide rails, e.g., 80, abut their associate guide rail necks or abutments, e.g., 121 (see also FIG. 8).

Figure 10:
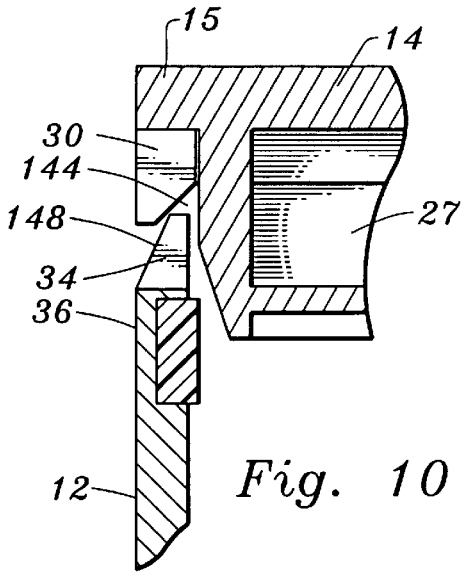
FIG. 10 is a partial cross-sectional view taken along section line 10—10 of FIG. 1 but with the lid slightly opened and the locking pin returned to its free state, spring-biased position.

Referring now to FIG. 10, when the hinged lid 14 is slightly open and the T-lock 30 is in the free state position, the T-lock 30 is located immediately above and adjacent the locking edges, e.g., 34, on the container body 12. The hinge lid 14 may be easily closed by means of a single hand motion downwardly on the upper surface 15 of the hinged lid 14 as shown in FIGS. 10 through FIG. 14.

Figure 11:
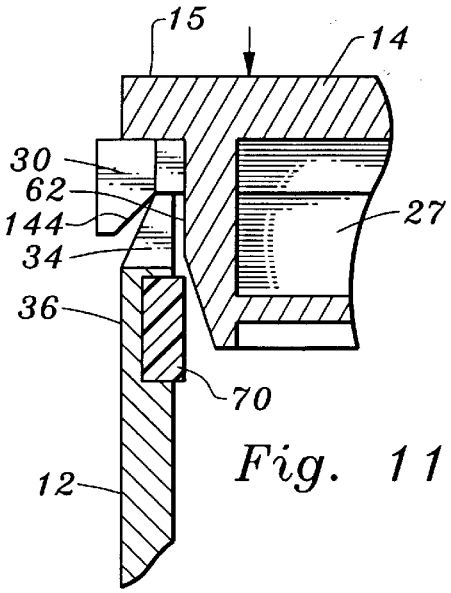
FIG. 11 is a partial cross-sectional view of the lid shown in FIG. 10 but with the lid being rotated by the user downwardly into force fit alignment with the lip of the container.
Figure 12:
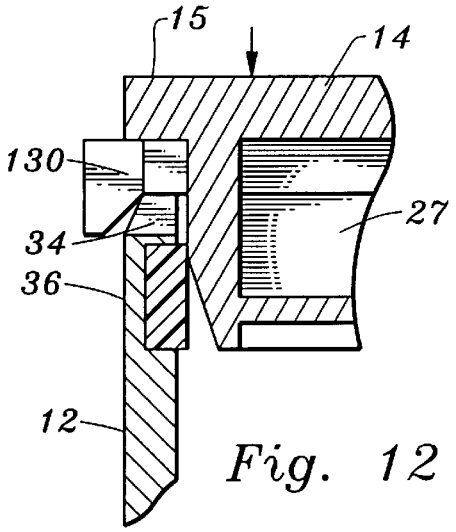
FIG. 12 is a partial cross-sectional view of the lid of FIG. 11 but with the lid being rotated even closer into the locked or sealed position on the container lip.

With reference to FIG. 11, as the hand (not shown) pushes downwardly on the upper surface 15 of the lid 14, the interior sloped surface 144 of the T-lock 30 engages the oppositely sloped periphery 148 of the adjacent locking edge, e.g., 34. With reference now to FIG. 12, the continuing downward force of the hand (not shown) on the upper surface 15 of the lid 14 forces the spring-biased T-lock 30 to slide along mating locking edge or neck 34 and thus move the T-lock 30 outwardly from the slideway 27 within the lid 14.

Figure 13:
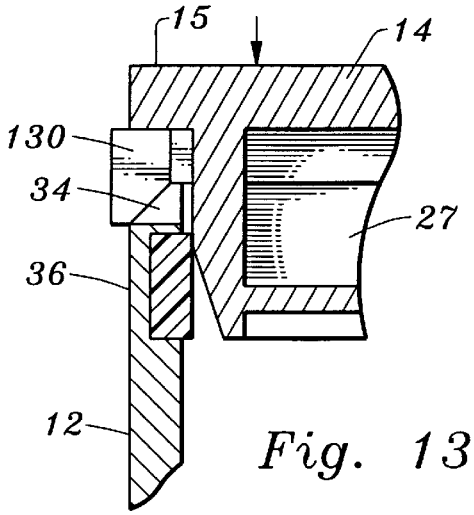
FIG. 13 is a partial cross-sectional view of the lid of FIG. 12 but with the lid being rotated into closed contact with the lip of the container, immediately prior to the locking pin returning to its spring-biased, locked position.
Figure 14:
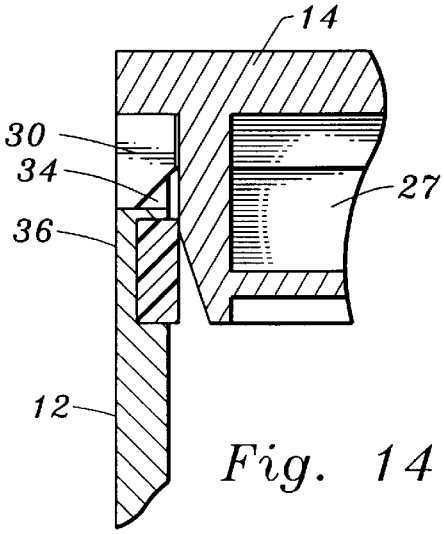
FIG. 14 is a partial cross-sectional view of the lid of FIG. 13, with the locking pin and lid in the spring biased, closed, and locked position.

With reference now to FIGS. 12, 13, and 14, the continued downward force of the hand (not shown) on the upper surface 15 of the lid 14 continues to force the spring-biased T-lock 30 to continue to slide along the mating locking edge 34 outwardly from the slideway 27 until, as shown in FIGS. 13 and 14, the T-lock no longer is in contact with the locking edges, e.g., 34, and is S-spring-biased to automatically slide quickly back into the slideway 27. When, as shown in FIGS. 14 and 1, the spring-biased T-lock and associated structures thus slide back into the slideway 27 (not shown in FIG. 1), the opposing lateral sides 150, 152 (not shown in FIG. 14) respectively force-fit abut and lockingly engage the mating locking edges 32, 34 respectively, in the upper lip 36 of the container body 12.

It can thus be seen that the applicant's preferred embodiment 10 may initially be dispensed to a user with the locking tab 29 flexed in the lock-out position as shown in FIG. 8. In order to open the preferred container, the user must first comprehend and have the dexterity to rotate the flexed locking tab 29 into the non-flexed, open position as shown in FIG. 9. The user must then also comprehend and have the strength and dexterity to force the internally biased actuation pad 28 to slide into the slideway 27 and thus push the T-lock 30 out of its force-fit locking and closing engagement with the opposing mating locking edges 32, 34. Only then can the user open the hinge lid 14 by rotating it upwardly with yet another hand motion. If dexterity is lacking, the user can press the actuation pad 28 against a table edge to move the pad 28.

It can also be seen that the user can then, if desired, leave the locking tab 29 in its non-flexed, open position as shown in 3. The user can thus more easily and quickly open and close the container 10 with the single, quick closing motion described above with reference to FIGS. 10–14 and without altering the position of the locking tab 29. Alternatively, the user can utilize the locking tab 29 by re-positioning it in the flexed, lock-out position of FIG. 8 after each closing of the container 10.

It can also be seen that, as shown in all the Figures, this substantial functionality is achieved with a single integral locking pin 26 (as shown in FIG. 6) interacting with associated structure in the molded hinge lid 14. This integral pin 26 is relatively easy and economical to manufacture and install in the container slideway 27; and the remaining components of the container 10 are also relatively easy and economical to manufacture and assemble.

It is to be understood that, in the foregoing detailed description and accompanying drawings, the applicant has described and shown in detail how to make and use the applicant's preferred embodiment. It is to be understood, however, that the scope of the applicant's invention is to be determined by the accompanying claims.

I claim:

1. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion;

and, a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin;

wherein the locking pin is slidably mounted in a pin channel in the cover portion and the locking tab is rotatably mounted in the cover portion to rotate between the opening position and the lock-out position.

2. The safety container of claim 1 wherein the cover portion includes a locking pin abutment and the locking pin includes a neck that engages the pin abutment to prevent the locking pin from further penetration of the pin channel, and wherein the tab detent penetrates the pin abutment.

3. The safety container of claim 2 wherein the locking pin is made of a resilient material and has a spring integrally formed in the locking pin with a springing section adapted to engage the cover portion, whereby the locking pin is biased to slide into the locked position.

4. The safety container of claim 3 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

5. The safety container of claim 1 wherein the cover portion is rotatably mounted on the container portion on a first side of the cover portion opposite a second side of the cover portion at which the locking pin is adapted to lockingly engage the lip portion.

6. The safety container of claim 5 wherein the locking pin is made of a resilient material and has a spring integrally formed in the locking pin with a springing section adapted to engage the cover portion, whereby the locking pin is biased to slide into the locked position.

7. The safety container of claim 6 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

8. The safety container of claim 1 wherein the locking pin is made of a resilient material and has a spring integrally formed in the locking pin with a springing end engaging the cover portion, whereby the locking pin is biased to slide into the locked position.

9. The safety container of claim 8 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

10. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion; and a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin;

wherein the locking pin includes a spring biasing the locking pin in the locking position.

11. The safety container of claim 10 wherein the spring is S-shaped and includes a springing end having a transversely extending spring lip adapted to abut a lip abutment in the cover portion, whereby the spring and cover portion cooperatively bias the cover portion to slide into the locked position.

12. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion;

a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin; and a locking tab retainer mounted in the cover portion, whereby the locking tab is retained in either the opening position or the lock-out position;

wherein the locking pin includes a spring biasing the locking pin in the locking position.

13. The safety container of claim 12 wherein the spring is S-shaped and includes a springing end having a transversely extending spring lip adapted to securely abut a lip abutment in the cover portion, whereby the spring and cover portion cooperatively bias the cover portion to slide into the locked position.

14. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion; and a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin;

wherein the locking pin is made of a resilient material and has a spring integrally formed in the locking pin with a springing end engaging the cover portion, whereby the locking pin is biased to move into the locked position.

15. The safety container of claim 14 wherein the spring is S-shaped and the second springing section includes a spring lip extending transversely from the plane of the S-shaped spring to abut a lip abutment in the cover portion, whereby the spring and cover portion cooperatively bias the cover portion to slide into the locked position.

16. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion; and a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin;

wherein the cover portion is rotatably mounted on the container portion on a first side of the cover portion opposite a second side of the cover portion at which the locking pin is adapted to lockingly engage the lip portion;

wherein the locking pin is made of a resilient material and has a spring integrally formed in the locking pin with a springing section adapted to engage the cover portion, whereby the locking pin is biased to slide into the locked position.

17. The safety container of claim 16 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

18. A safety container, comprising, in combination:

a container portion having a container body and a lip portion surrounding a passage in the body;

a cover portion conforming to at least a section of said lip portion;

a locking pin mounted with respect to the cover portion and adapted to move between: (i) a locked position lockingly engaging the lip portion; and (ii) an open position disengaging the locking pin from locking engagement with the lip portion;

a tab detent in the cover portion;

a locking tab in the cover portion moveable between: (i) an opening position in which the locking tab may penetrate the tab detent and allow relative movement between the cover portion and locking pin; and (ii) a lock-out position in which the locking tab may not penetrate the tab detent and allow relative movement between the cover portion and locking pin;

and, a locking tab retainer mounted in the cover portion, whereby the locking tab is retained in either the opening position or the lock-out position;

wherein the locking pin is slidably mounted in a pin channel in the cover portion and the locking tab is rotatably mounted in the cover portion to rotate between the opening position and the lock-out position.

19. The safety container of claim 18 wherein the locking tab is rotatably mounted about a locking tab axis in the cover portion, the locking tab retainer includes a tab protuberance extending toward the locking tab axis, and the locking tab is flexible and flexes about the periphery of the tab protuberance upon movement of the locking tab between the opening and lock-out positions.

20. The safety container of claim 19 wherein the locking pin is adapted to slide in a slide plane perpendicularly intersecting at least a section of the lip portion and the locking tab axis perpendicularly intersects the slide plane.

21. The safety container of claim 20 wherein the cover portion includes a locking pin abutment and the locking pin includes a neck that engages the pin abutment to prevent the locking pin from further penetration of the pin channel, and wherein the tab detent penetrates the pin abutment.

22. The safety container of claim 21 wherein the cover portion is rotatably mounted on the container portion on a first side of the cover portion opposite a second side of the cover portion at which the locking pin is adapted to lockingly engage the lip portion.

23. The safety container of claim 22 wherein the locking pin is made of a resilient material and has a spring integrally formed in the locking pin with a springing section adapted to engage the cover portion, whereby the locking pin is biased to slide into the locked position.

24. The safety container of claim 21 wherein the locking pin is made of a resilient material and has a spring integrally formed in the locking pin with a springing end engaging the cover portion, whereby the locking pin is biased to slide into the locked position.

25. The safety container of claim 24 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

26. The safety container of claim 20 wherein the cover portion is rotatably mounted on the container portion on a first side of the cover portion opposite a second side of the cover portion at which the locking pin is adapted to lockingly engage the lip portion.

27. The safety container of claim 26 wherein the locking pin is made of a resilient material and has a spring integrally formed in the locking pin with a springing section adapted to engage the cover portion, whereby the locking pin is biased to slide into the locked position.

28. The safety container of claim 27 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

29. The safety container of claim 20 wherein the locking pin is made of a resilient material and has a spring integrally formed in the locking pin with a springing section adapted to engage the cover portion, whereby the locking pin is biased to slide into the locked position.

30. The safety container of claim 29 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

31. The safety container of claim 19 wherein the cover portion includes a locking pin abutment and the locking pin includes a neck that engages the pin abutment to prevent the locking pin from further penetration of the pin channel, and wherein the tab detent penetrates the pin abutment.

32. The safety container of claim 31 wherein the locking pin is made of a resilient material and has a spring integrally formed in the locking pin with a springing section adapted to engage the cover portion, whereby the locking pin is biased to slide into the locked position.

33. The safety container of claim 32 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

34. The safety container of claim 19 wherein the cover portion is rotatably mounted on the container portion on a first side of the cover portion opposite a second side of the cover portion at which the locking pin is adapted to lockingly engage the lip portion.

35. The safety container of claim 34 wherein the locking pin is made of a resilient material and has a spring integrally formed in the locking pin with a springing section adapted to engage the cover portion, whereby the locking pin is biased to slide into the locked position.

36. The safety container of claim 35 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

37. The safety container of claim 19 wherein the locking pin is made of a resilient material and has a spring integrally formed in the locking pin with a springing end adapted to engage the cover portion, whereby the locking pin is biased to slide into the locked position.

38. The safety container of claim 37 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

39. The safety container of claim 18 wherein the locking pin is slidably mounted to slide in a slide plane perpendicularly intersecting at least a section of the lip portion and the locking tab is rotatably mounted about a locking tab axis perpendicularly intersecting the slide plane.

40. The safety container of claim 39 wherein the cover portion includes a locking pin abutment and the locking pin includes a neck that engages the pin abutment to prevent the locking pin from further penetration of the pin channel, and wherein the tab detent penetrates the pin abutment.

41. The safety container of claim 40 wherein the cover portion is rotatably mounted on the container portion on a first side of the cover portion opposite a second side of the cover portion at which the locking pin is adapted to lockingly engage the lip portion.

42. The safety container of claim 41 wherein the locking pin is made of a resilient material and has a spring integrally formed in the locking pin with a springing section adapted to engage the cover portion, whereby the locking pin is biased to slide into the locked position.

43. The safety container of claim 40 wherein the locking pin is made of a resilient material and has a spring integrally formed in the locking pin with a springing end adapted to engage the cover portion, whereby the locking pin is biased to slide into the locked position.

44. The safety container of claim 43 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

45. The safety container of claim 39 wherein the cover portion is rotatably mounted on the container portion on a first side of the cover portion opposite a second side of the cover portion at which the locking pin is adapted to lockingly engage the lip portion.

46. The safety container of claim 45 wherein the locking pin is made of a resilient material and has a spring integrally formed in the locking pin with a springing section adapted to engage the cover portion, whereby the locking pin is biased to slide into the locked position.

47. The safety container of claim 46 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

48. The safety container of claim 39 wherein the locking pin is made of a resilient material and has a spring integrally formed in the locking pin with a springing section adapted to engage the cover portion, whereby the locking pin is biased to slide into the locked position.

49. The safety container of claim 48 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

50. The safety container of claim 18 wherein the cover portion includes a locking pin abutment and the locking pin includes a neck that engages the pin abutment to prevent the locking pin from further penetration of the pin channel, and wherein the tab detent penetrates the pin abutment.

51. The safety container of claim 50 wherein the cover portion is rotatably mounted on the container portion on a first side of the cover portion opposite a second side of the cover portion at which the locking pin is adapted to lockingly engage the lip portion.

52. The safety container of claim 51 wherein the locking pin is made of a resilient material and has a spring integrally formed in the locking pin with a springing section adapted to engage the cover portion, whereby the locking pin is biased to slide, into the locked position.

53. The safety container of claim 52 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

54. The safety container of claim 50 wherein the locking pin is made of a resilient material and has a spring integrally formed in the locking pin with a springing section adapted to engage the cover portion, whereby the locking pin is biased to slide into the locked position.

55. The safety container of claim 54 wherein the spring is S-shaped and the second springing section includes a spring lip extending transversely from the plane of the S-shaped spring to abut the pin abutment in the cover portion, whereby the spring and cover portion cooperatively bias the cover portion to slide into the locked position.

56. The safety container of claim 18 wherein the locking pin is made of a resilient material and has a spring integrally formed in the locking pin with a springing end adapted to engage the cover portion, whereby the locking pin is biased to slide into the locked position.

57. The safety container of claim 56 wherein the spring is S-shaped and the second springing section includes a spring lip extending transversely from the plane of the S-shaped spring to securely abut a lip abutment in the cover portion, whereby the spring and cover portion cooperatively bias the cover portion to slide into the locked position.

* * * * *